US010161414B2

(12) United States Patent
Eastwood et al.

(10) Patent No.: US 10,161,414 B2
(45) Date of Patent: Dec. 25, 2018

(54) HIGH COMPRESSOR EXIT GUIDE VANE ASSEMBLY TO PRE-DIFFUSER JUNCTION

(71) Applicant: UNITED TECHNOLOGIES CORPORATION, Farmington, CT (US)

(72) Inventors: Jonathan Jeffery Eastwood, Newington, CT (US); Dave J. Hyland, Portland, CT (US); Timothy Dale, Manchester, CT (US); Matthew R. Willett, Portsmouth, NH (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 158 days.

(21) Appl. No.: 14/935,628

(22) Filed: Nov. 9, 2015

(65) Prior Publication Data

US 2016/0169245 A1 Jun. 16, 2016

Related U.S. Application Data

(60) Provisional application No. 62/092,054, filed on Dec. 15, 2014.

(51) Int. Cl.
*F04D 29/54* (2006.01)
*F04D 29/08* (2006.01)
(Continued)

(52) U.S. Cl.
CPC ..... *F04D 29/542* (2013.01); *F01D 9/023* (2013.01); *F01D 9/041* (2013.01); *F01D 11/005* (2013.01);
(Continued)

(58) Field of Classification Search
CPC ..... F04D 29/542; F04D 29/083; F04D 9/023; F04D 9/041; F04D 11/005;
(Continued)

(56) References Cited

U.S. PATENT DOCUMENTS

| | | | | |
|---|---|---|---|---|
| 5,249,921 | A | 10/1993 | Stueber et al. | |
| 6,364,606 | B1 | 4/2002 | Rice et al. | |
| 7,819,622 | B2 * | 10/2010 | Paulino | F01D 9/041 415/104 |

FOREIGN PATENT DOCUMENTS

| | | | |
|---|---|---|---|
| EP | 1939404 | A2 | 7/2008 |
| WO | 2015017000 | A2 | 2/2015 |

OTHER PUBLICATIONS

European Search Report for Application No. 15200183.0-1607; dated May 10, 2016; 7 pgs.

* cited by examiner

*Primary Examiner* — Logan Kraft
*Assistant Examiner* — Eric Zamora Alvarez
(74) *Attorney, Agent, or Firm* — Cantor Colburn LLP

(57) ABSTRACT

A pre-diffuser and exit guide vane (EGV) system for a gas turbine engine includes an annular EGV assembly containing a number of guide vanes and having an annular opening bounded by a radially inner annular sealing surface at a first radius and a radially outer annular sealing surface at a second radius. First and second seals substantially matching the first and second radii respectively join the EGV assembly to an annular pre-diffuser having an annular opening bounded by radially inner and outer annular sealing surfaces at substantially the first and second radii. The seals seal the inner sealing surface of the EGV assembly to the inner sealing surface of the pre-diffuser and the second seal seals the outer sealing surface of the EGV assembly to the outer sealing surface of the pre-diffuser, such that the EGV
(Continued)

assembly annular opening is in fluid communication with the annular opening of the pre-diffuser.

15 Claims, 6 Drawing Sheets

(51) Int. Cl.
*F01D 9/02* (2006.01)
*F01D 11/00* (2006.01)
*F01D 9/04* (2006.01)

(52) U.S. Cl.
CPC .... *F04D 29/083* (2013.01); *F05D 2220/3219* (2013.01); *F05D 2230/642* (2013.01); *F05D 2260/36* (2013.01)

(58) Field of Classification Search
CPC ..... F05D 220/3219; F05D 2230/642; F05D 2260/36; F01D 9/023; F01D 9/041; F01D 11/005
See application file for complete search history.

HIGH COMPRESSOR EXIT GUIDE VANE ASSEMBLY TO PRE-DIFFUSER JUNCTION

CROSS REFERENCE TO RELATED APPLICATIONS

This application is a non-provisional application claiming the 35 U.S.C. § 119(e) benefit of U.S. Provisional Patent Application No. 62/092,054 filed on Dec. 15, 2014.

TECHNICAL FIELD

This disclosure relates generally to gas turbine engines and, more particularly, to a system and method for connecting a high compressor exit guide vane assembly to a pre-diffuser assembly within a gas turbine engine.

BACKGROUND

Many modern aircraft, as well as other vehicles and industrial processes, employ gas turbine engines for generating energy or propulsion. Such engines generally include a fan, a compressor, a combustor and a turbine arranged in that order from first to last along a central longitudinal axis.

In operation, atmospheric air enters the gas turbine engine through the fan and at least a portion of that air passes through the compressor and is pressurized. The pressurized air is then mixed with fuel in the combustor. Within the combustor, the fuel-air mixture is ignited, generating hot combustion gases that flow axially to the last stage of the core, i.e., the turbine. The turbine is driven by the exhaust gases and the turbine's rotation mechanically powers the compressor and fan via a central rotating shaft, maintaining the combustion cycle. After passing through the turbine, the exhaust gas exits the engine through an exhaust nozzle.

While a portion of the incoming atmospheric air passes through the compressor, combustor and turbine as discussed above, another portion of the incoming air may pass only through the fan before being routed around the core. This air "bypasses" the core, but provides thrust nonetheless due to being accelerated by the fan and routed through the engine nacelle (outside the core). The engine may be optimized to provide either thrust (e.g., with a substantial bypass around the core) or shaft power (e.g., with no bypass and an efficient power-absorbing turbine) depending upon the intended application of the engine.

In either arrangement, the high compression stage of the engine feeds into the combustor within the core. At the junction between the high compression stage and the combustor, a static exit guide vane (EGV) assembly minimizes rotation and turbulence that was introduced into the airflow by the compressor stage. From the EGV assembly, a pre-diffuser expands and slows the airflow entering the combustor.

However, as the gas turbine engine operates, the various engine components absorb different amounts of heat energy, which may in turn cause different rates of thermal expansion in the components. This problem is particularly acute between the EGV assembly, which has low mass and thin elements, and the pre-diffuser, which is significantly more massive. The differential in thermal expansion rates can lead to disproportionate stresses on the less massive EGV assembly, which may then require frequent checking, repair and replacement.

SUMMARY OF THE DISCLOSURE

This disclosure provides a pre-diffuser and EGV system for a gas turbine engine. In an embodiment, the system includes an EGV assembly containing a plurality of radially directed guide vanes and having an annular output flow opening bounded by a radially inner annular sealing surface at a first radius and a radially outer annular sealing surface at a second radius greater than the first radius. First and second annular seals are provided essentially conforming to the radii of the radially inner annular sealing surface and radially outer annular sealing surface. Similarly, the pre-diffuser includes an annular input flow opening bounded by inner annular sealing surface and a radially outer annular sealing surface. The pre-diffuser is interfaced to the EGV assembly via the seals such that the first seal seals the inner sealing surface of the EGV assembly to the inner sealing surface of the pre-diffuser across a first gap and the second seal seals the outer sealing surface of the EGV assembly to the outer sealing surface of the pre-diffuser across a second gap. In a further embodiment, the first and second seals are w-seals.

In a further embodiment, the EGV assembly includes a first set of tabs extending axially toward the pre-diffuser and the pre-diffuser includes a second set of tabs extending axially toward the EGV assembly, such that the first set of tabs and the second set of tabs interlock to prevent rotation of the EGV assembly relative to the pre-diffuser.

In yet a further embodiment, the first set of tabs and the second set of tabs are configured such that one set is arranged in pairs and the other set are arranged singly in order to fit between respective pairs. The second set of tabs may be supported by an inner diffuser case rather than being affixed directly to the pre-diffuser itself.

In another embodiment, a gas turbine engine is provided having a compressor, an EGV assembly downstream of the compressor and a pre-diffuser downstream of the EGV assembly configured to receive an airflow exiting the EGV assembly. An annular sealing system provided between the EGV assembly and the pre-diffuser accommodates differential axial and radial thermal expansion of the pre-diffuser and the EGV assembly while preventing relative rotation between these components.

Within this embodiment, the annular sealing system between the EGV assembly and the pre-diffuser includes first and second annular w-seals spanning first and second gaps between the EGV assembly and the pre-diffuser.

In a further aspect, the annular sealing system includes a first set of tabs affixed to the EGV assembly and extending axially toward the pre-diffuser, and a second set of tabs associated with the pre-diffuser and extending axially toward the EGV assembly. In a further related embodiment, the first and second sets of tabs interlock to prevent rotation of the EGV assembly relative to the pre-diffuser. In a further aspect, the tabs may be associated as a set of single tabs on one side of the junction between the EGV assembly and pre-diffuser fitting between pairs of tabs on an opposite side of the junction. The tabs associated with the pre-diffuser may be formed on an inner diffuser case.

In another embodiment, a method is provided for affixing and sealing a gas turbine engine EGV assembly to a pre-diffuser. The EGV assembly includes an annular output flow opening and the pre-diffuser includes an annular input flow opening. A plurality of seals are placed between the EGV assembly and the pre-diffuser such that forcing the assemblies together seals the output flow opening of the EGV assembly to the input flow opening of the pre-diffuser. An anti-rotation system is engaged to allow differential axial and radial thermal expansion between the pre-diffuser and the EGV assembly while preventing relative rotation between them. In an aspect of this embodiment the seals span respective gaps between the EGV assembly and the pre-diffuser.

The EGV assembly may include a first set of tabs extending axially toward the pre-diffuser, and the pre-diffuser may include a second set of tabs extending axially toward the EGV assembly, such that interlocking the first set of tabs and the second set of tabs provides an anti-rotation mechanism. As noted above, one set of tabs may be arranged in pairs while the other set of tabs may include a series of single tabs sized and located so that each fits between a respect tab pair in the other set.

These and other aspects and features of the present disclosure will be better understood upon reading the following detailed description when taken in conjunction with the accompanying drawings.

BRIEF DESCRIPTION OF THE DRAWINGS

For a more detailed understanding of the disclosed concepts and embodiments, reference is made to the following detailed description, read in connection with the attached drawings, wherein like elements are numbered alike, and in which.

It will be appreciated that the appended drawings illustrate embodiments of the disclosed principles to enhance reader understanding and are not to be considered limiting with respect to the scope of the disclosure or claims. Rather, the concepts of the present disclosure may apply within other equally effective embodiments. Moreover, the drawings are not necessarily to scale, emphasis generally being placed upon illustrating the principles of the illustrated and disclosed embodiments.

DETAILED DESCRIPTION OF THE INVENTION

The disclosure is directed at least in part to a system and method for minimizing thermal stress, and associated wear, on the EGV assembly within a gas turbine engine. While the EGV assembly may be joined to the pre-diffuser as-cast, or by later welding or bolting the two together, this arrangement will not avoid the imposition of undue thermal stress on the EGV.

In particular, even when the EGV assembly and pre-diffuser form a single unit, it is impractical in most cases to create a sufficiently massive thermal path between the two. Thus, while fixing the two elements together may force uniform contraction and expansion, this will not eliminate the disproportionate thermal stress within the EGV assembly.

However, in an embodiment of the disclosed principles, a junction and mounting between the EGV assembly and the pre-diffuser allow the EGV assembly to expand and contract at a significantly different rate and extent than the pre-diffuser. Using this junction and mounting, the EGV assembly also remains in position, axially and rotationally, relative to the pre-diffuser, and remains sealed to the pre-diffuser.

Figure 1:
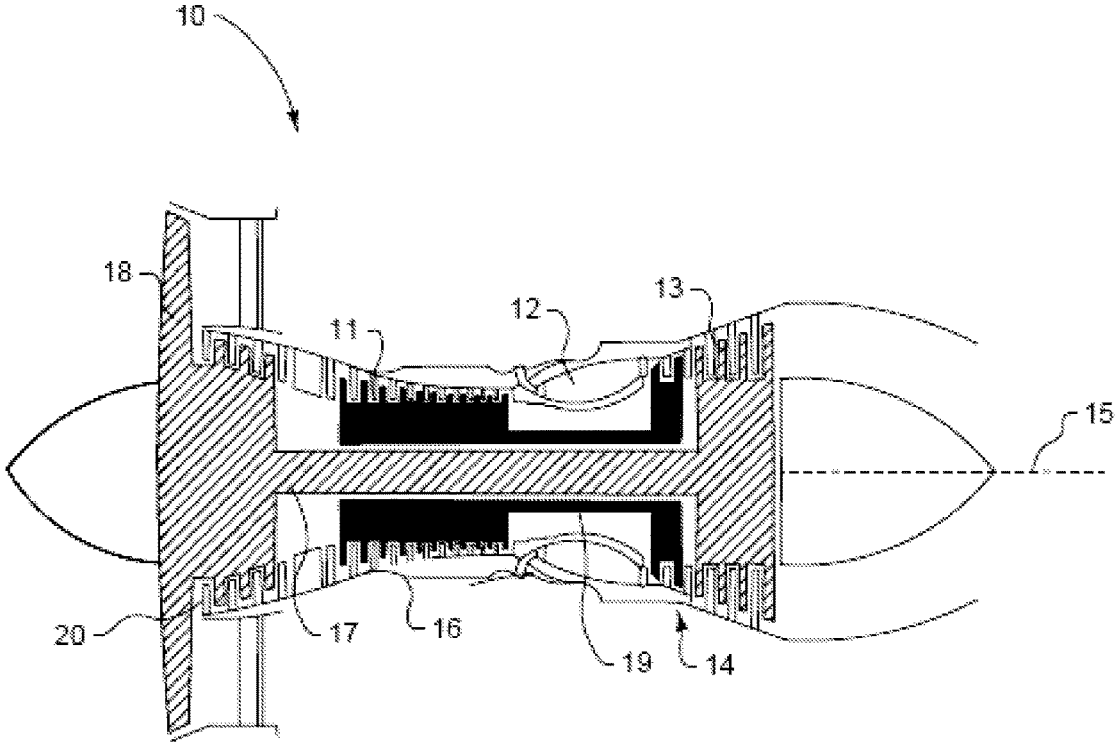
FIG. 1 is a sectional side view of an example gas turbine engine within which various embodiments of the disclosed principles may be implemented.

With this overview in mind, and turning now to the drawings, a gas turbine engine 10 within which embodiments of the disclosed principles may be implemented is shown in FIG. 1. The engine core 14 of the gas turbine engine 10 as illustrated includes a compressor 11, combustor 12 and turbine 13 lying along a central longitudinal axis 15. The engine core 14 is surrounded by an engine core cowl 16. The compressor 11 is connected to the turbine 13 via a central rotating shaft 17. In what may be referred to as a multi-spool design, multiple turbines 13 may be connected to, and drive, corresponding multiple sections of the compressor 11 and a fan 18 via the central rotating shaft 17 and a concentric rotating shaft 19. This arrangement may yield greater compression efficiency, and the principles described herein permit, but do not require, a multi-spool design for implementation.

As discussed above and as will be readily appreciated by those skilled in the art, ambient air enters the compressor 11 at an inlet 20 during operation of the engine, is pressurized, and is then directed to the combustor 12 where it is mixed with fuel and combusted. The combustion generates combustion gases that flow downstream to the turbine 13, which extracts a portion of the kinetic energy of the exhausted combustion gases. With this energy, the turbine 13 drives the compressor 11 and the fan 18 via central rotating shaft 17 and concentric rotating shaft 19. Thrust is produced both by ambient air accelerated aft by the fan 18 around the engine core 14 and by exhaust gasses exiting from the engine core 14 itself.

Figure 2:
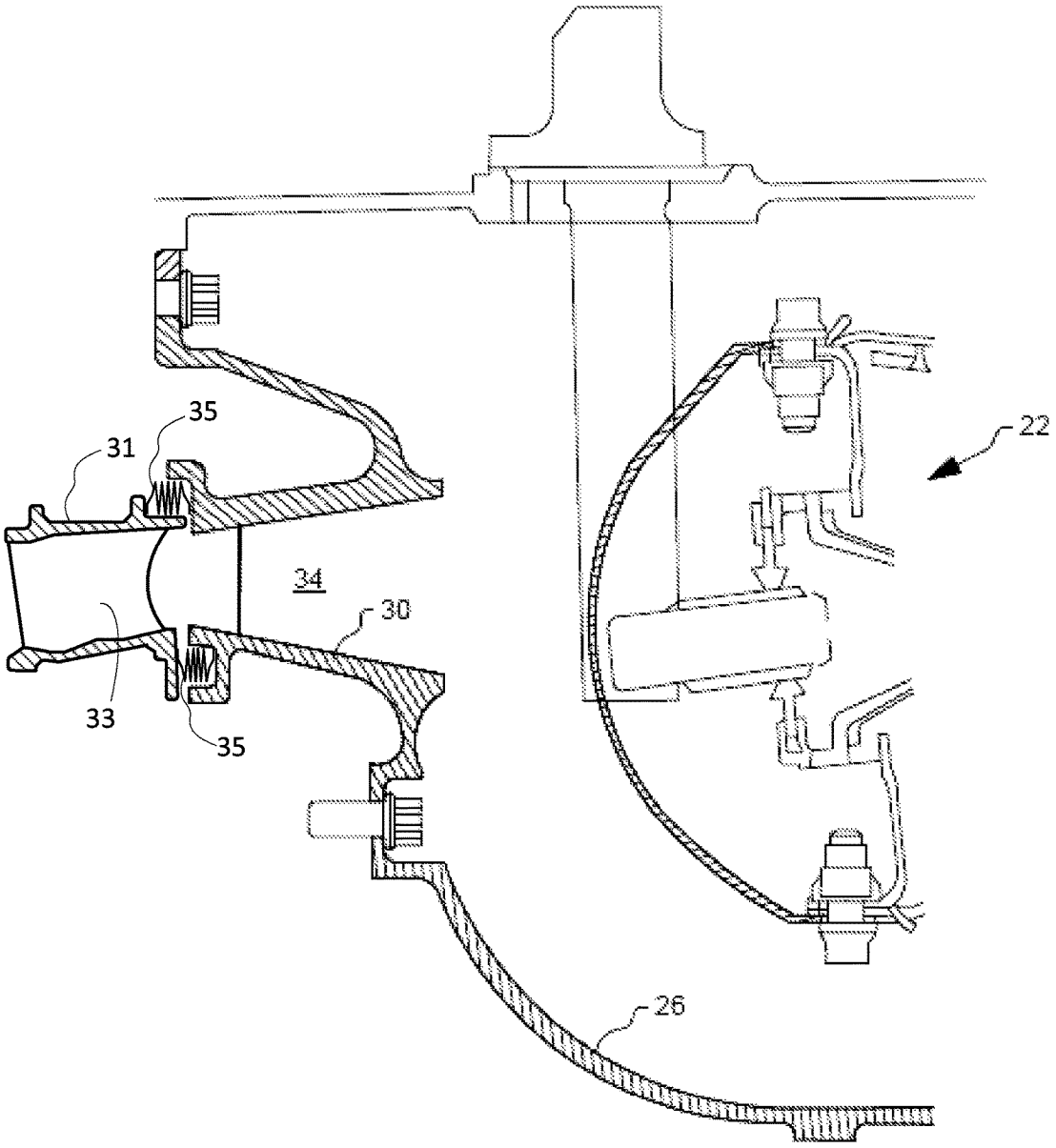
FIG. 2 is a sectional side view of a diffuser assembly constructed in accordance with the present disclosure.

As air enters the compressor 11, it is accelerated aft at high speed and pressure. Prior to reaching the combustor assembly 22 and an inner diffuser case 26, as shown in FIG. 2, the compressed air passes through an EGV assembly 31 and a pre-diffuser 30. The EGV assembly 31 is of a generally annular shape and contains a plurality of radially extending vanes 33 that straighten and smooth the airflow out of the compressor (not shown in FIG. 2).

The pre-diffuser 30 in the illustrated configuration contains one or more passages 34 allowing air to flow from the EGV assembly 31 through to the combustor assembly 22. The one or more passages include expanding areas to slow the airflow from the compressor 11 and allow more efficient combustion in the combustor assembly 22.

As discussed above, components of the gas turbine engine 10 absorb and react to thermal energy differently, and may thus exhibit varying degrees of thermal expansion or, where physical constraints prevent differential expansion, varying degrees of thermal stress. In particular, the low mass EGV assembly 31 may tend to experience more rapid and significant thermal expansion than the pre-diffuser 30. Therefore, if the EGV assembly 31 and pre-diffuser 30 are fixed together as a unit, this difference in free expansion leads to increased thermal stress in the EGV assembly 31, potentially leading to damage and consequent increased maintenance costs and down time for inspection and repair or replacement of the EGV assembly 31.

Figure 3:
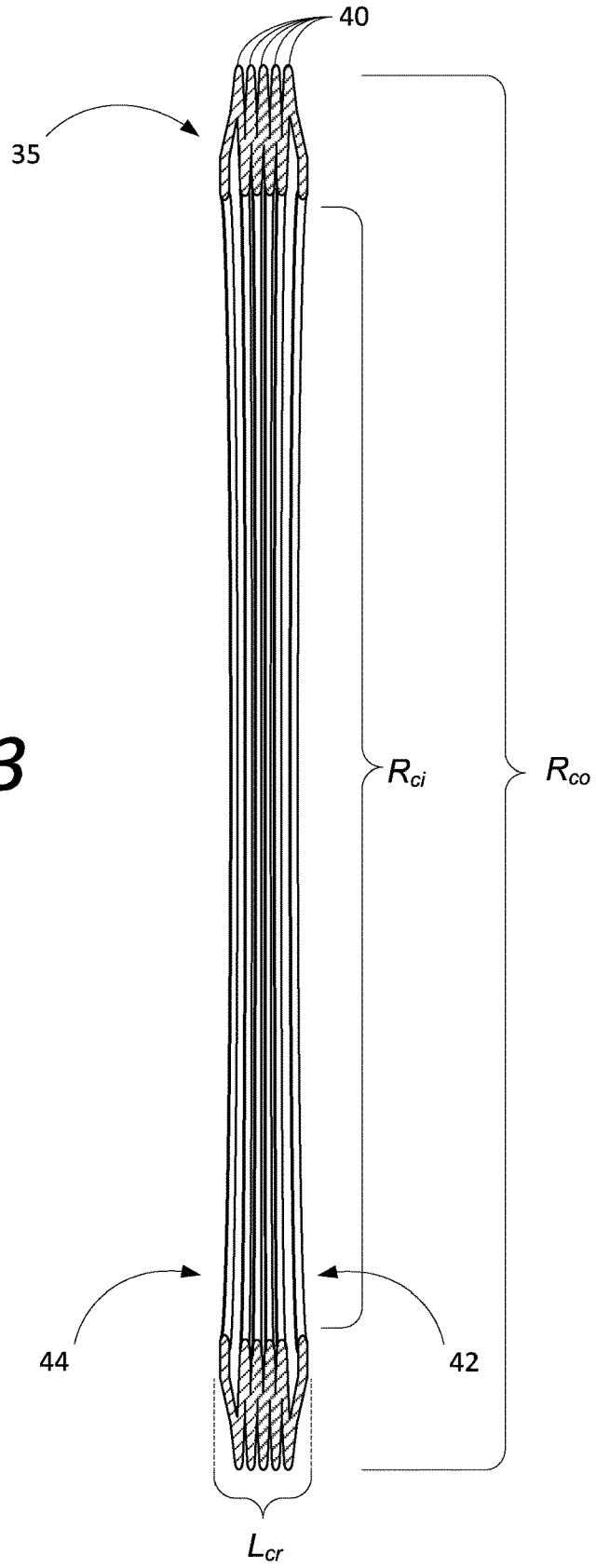
FIG. 3 is a sectional side view of an annular w-seal in accordance with an embodiment of the present disclosure.

In the illustrated embodiment, the EGV assembly 31 and the pre-diffuser 30 are linked by two w-seals 35. Each w-seal 35 is formed as a low profile annular bellows comprising a series of connected folds 40, as shown in FIG. 3, and is open at each end 42, 44. Each w-seal 35 has a cold resting internal radius of $R_{ci}$ and a cold resting external radius of $R_{co}$. Moreover, in general terms, each w-seal 35 has a cold resting width of $L_{cr}$ and a spring constant of $k_w$. It will be appreciated that different w-seals 35 may exhibit different respective radii, widths and spring constants depending upon intended installation location and tolerances.

Figure 4:
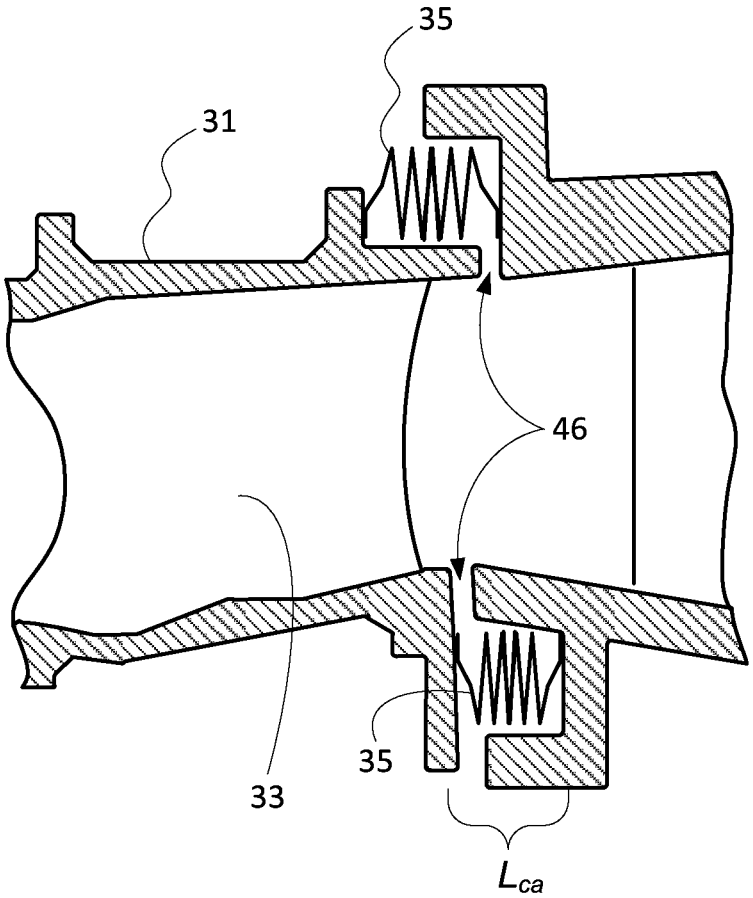
FIG. 4 is a sectional side view of a pre-diffuser/EGV junction in keeping with the present disclosure.

As shown in FIG. 4, in the cold assembled condition, each w-seal 35 is compressed axially such that its cold assembled width is $L_{ca}$, with $L_{ca}<L_{cr}$. This results in a sealing force at each sealed surface (e.g., each surface axially abutting either end of the w-seal 35) of $F_{ca}$, where $F_{ca}$ may be represented by the product $k_w(L_{cr}-L_{ca})$.

In addition to providing a reactive sealing force, the compressed form of the installed w-seals 35 also allows the sealed surfaces to move relative to one another. However, in order for this relative movement to occur, gaps are provided in the assembled junction in an embodiment. Thus, for example, the gaps 46 between the EGV assembly 31 and the pre-diffuser 30 allow for differential thermally induced radial and axial expansion of each assembly.

In an embodiment, the gaps 46 and other gaps are provided to allow for differential expansion are sized so as to approach a closed position during expansion without entirely closing at the maximum expected operating temperature. This allows a full range of expansion without exposing the w-seals 35 to undue stress caused by sealing unnecessarily large gaps.

Figure 5:
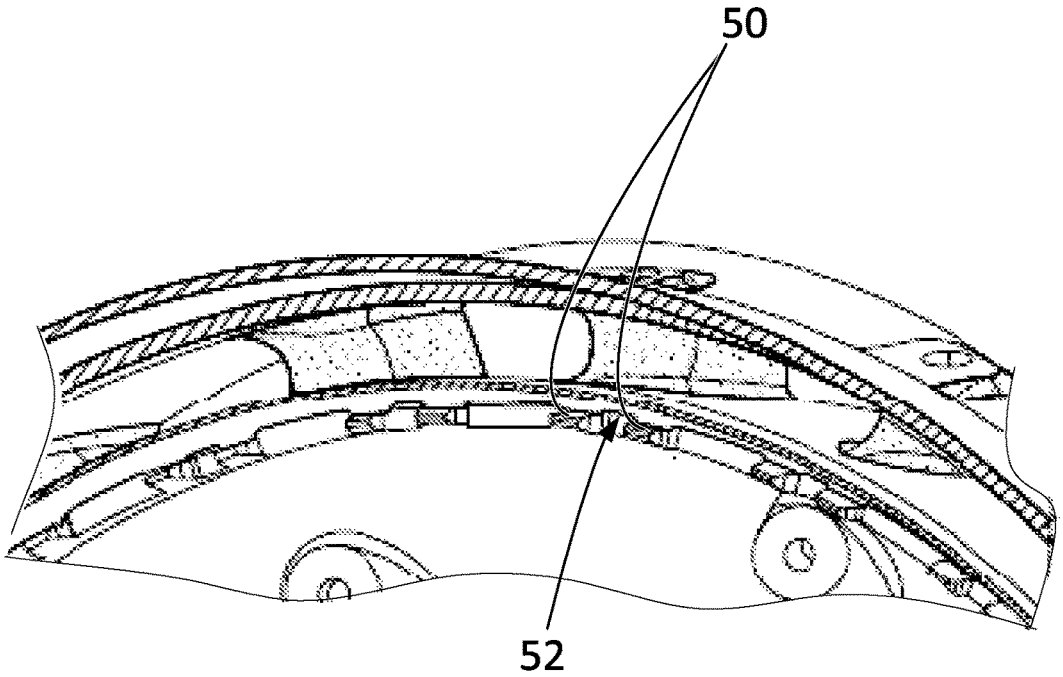
FIG. 5 is a partial perspective view of an EGV assembly and a pre-diffuser constructed in accordance with an embodiment of the present disclosure.
Figure 5:
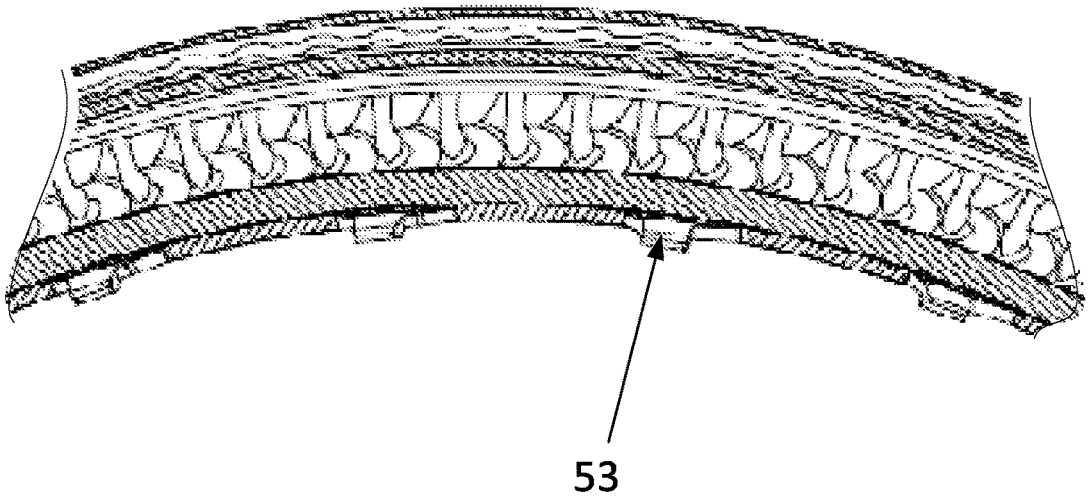

While it is beneficial that the EGV assembly 31 and the pre-diffuser 30 are allowed to expand at different rates axially and radially as noted above, it is also beneficial to prevent the EGV assembly 31 from rotating out of its installed orientation so that the assembly may serve its assigned role. To this end, a mounting system is provided as shown in FIG. 5 that allows the EGV assembly 31 to experience unimpeded axial and radial expansion, while fixing the EGV assembly 31 rotationally.

In particular, in the illustrated embodiment, an inner diffuser case 26 associated with the pre-diffuser 30 is provided with first anti-rotation tabs 50. As shown, the first anti-rotation tabs 50 are axially extending in the direction of the EGV assembly 31 and may be grouped in pairs with a small space 52 separating each pair. Corresponding second anti-rotation tabs 53 are provided on the EGV assembly 31 such that in the installed configuration, each of the second anti-rotation tabs 53 fits between a pair of the first antirotation tabs 50 to prevent rotation of the EGV assembly 31 relative to the pre-diffuser 30. As can be seen, the first antirotation tabs 50 and the second anti-rotation tabs 53 interfere with one another in the rotational dimension, but do not interfere axially or radially.

The various components of the gas turbine engine 10 may be formed of any suitable material considering performance requirements and cost. For example, some or all of the components may be made of a nickel alloy. More specifically, the nickel alloy may be Inconel 718™ or other suitable nickel alloy. Further, the method of forming each component is not critical, and any suitable technique may be used. For example, formation techniques include partial or whole casting, welding, and machining. However, it is anticipated that other techniques such as 3D printing and the like may also be used where appropriate based on performance requirements and cost.

Figure 6:
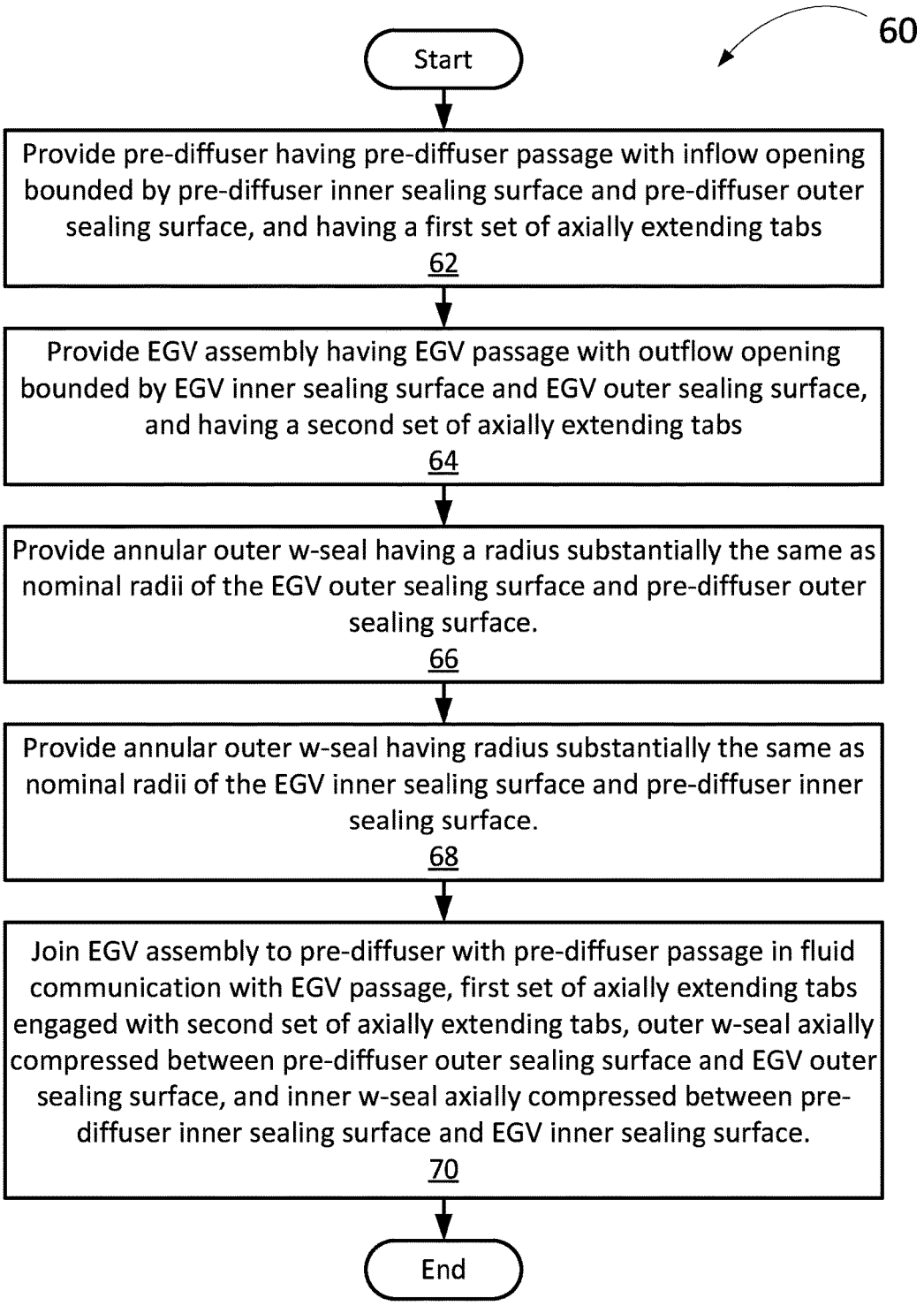
FIG. 6 is a flowchart showing a process of creating an EGV/pre-diffuser junction in keeping with the disclosed principles.

The flow chart of FIG. 6 shows an exemplary method of creating an EGV/pre-diffuser junction that allows both components freedom of expansion while containing the EGV assembly and pre-diffuser in a fixed rotational relationship. At the first stage, i.e., stage 62 of the illustrated process 60, an annular pre-diffuser is provided having therein an annular pre-diffuser passage having an annular inflow opening in fluid communication with the annular pre-diffuser passage, the annular inflow opening being bounded by an annular pre-diffuser inner sealing surface and an annular pre-diffuser outer sealing surface, and having a first set of axially extending tabs.

An annular EGV assembly is provided at stage 64, the annular EGV assembly having an annular EGV passage therein, with multiple vanes within the annular EGV passage and having an annular EGV outflow opening bounded by an annular EGV inner sealing surface and an annular EGV outer sealing surface. In an embodiment, the nominal radii of the annular EGV inner sealing surface and the annular pre-diffuser inner sealing surface are substantially the same. Similarly, the nominal radii of the annular EGV outer sealing surface and an annular pre-diffuser outer sealing surface are also substantially the same.

At stage 66 of the process 60, an annular outer w-seal is provided, having a radius that is substantially the same as the nominal radii of the annular EGV outer sealing surface and an annular pre-diffuser outer sealing surface. At stage 68, an annular inner w-seal is provided, having a radius that is substantially the same as the nominal radii of the annular EGV inner sealing surface and the annular pre-diffuser inner sealing surface.

Finally, at stage 70 of the process 60, the EGV assembly is joined to the pre-diffuser such that the pre-diffuser passage and the EGV passage are in fluid communication, the first set of axially extending tabs is engaged with a second set of axially extending tabs, the outer w-seal is axially compressed between the pre-diffuser outer sealing surface and the EGV outer sealing surface, and the inner w-seal is axially compressed between the pre-diffuser inner sealing surface and the EGV inner sealing surface.

INDUSTRIAL APPLICABILITY

In operation, the disclosed system and method find industrial applicability in a variety of settings. For example, the disclosure may be advantageously employed in the context of gas turbine engines More specifically, with respect to gas turbine engines having a high compressor EGV assembly 31 feeding into a pre-diffuser 30 upstream of the combustor, the disclosed principles allow decoupling of the thermal expansion of the EGV assembly 31 and the pre-diffuser 30. The decoupling of the thermal response of these elements permits the EGV assembly 31, containing a large number of thin structures and generally of a less robust construction, to expand at a different rate and/or to a different extent than pre-diffuser 30.

As such, the decoupling of the two elements reduces wear on the EGV assembly 31 due to thermal stress. However, the decoupling may also provide other benefits in implementation. For example, the expansion decoupling also serves to substantially decouple the frequency responses of the EGV assembly 31 and the pre-diffuser 30 from one another. Given this, the EGV assembly 31 (or pre-diffuser 30) may be separately used to tune the engine's frequency response, e.g., by driving the frequency response out of the engine operating frequency range.

While the principles of the described system and method have been shown and described by way of exemplary embodiments, those of skill in the art will appreciate that changes in minor details may be made without departing from the scope of the disclosure. Further, where these exemplary embodiments and related derivations are described with reference to certain elements it will be understood that other exemplary embodiments may be practiced utilizing either a fewer or greater number of elements, and that elements from different embodiments may be substituted or combined.

What is claimed is:

1. A system for a gas turbine engine, comprising an exit guide vane assembly that includes a first radially inner platform, a first radially outer platform, an axial outlet, and a plurality of exit guide vanes circumferentially distributed between the first radially inner platform and the first radially outer platform, wherein at the axial outlet, the first radially inner platform includes a first radially inner ring that extends radially inward to a first radially inner end, and a first plurality of tabs extend in an axial downstream direction from the first radially inner end, the first plurality of tabs being circumferentially spaced about the first radially inner end, a pre-diffuser assembly that includes a second radially inner platform, a second radially outer platform, and an axial inlet, wherein at the axial inlet, the second radially inner platform includes a second radially inner ring that extends radially inward to a second radially inner end, and a second plurality of tabs extend in an axial upstream direction from the second radially inner end, the second plurality of tabs being circumferentially spaced about the second radially inner end, wherein when the axial outlet of the exit guide vane is disposed axially against the axial inlet of the diffuser;

the first radially inner ring is radially aligned with, and axially opposes, the second radially inner ring so that the first radially inner ring forms a first inner W-seal land and the second radially inner ring forms a second inner W-seal land, and the first plurality of tabs are axially aligned with, and circumferentially engage, the second plurality of tabs to prevent rotation of the exit guide vane assembly relative to the pre-diffuser assembly.

2. The system of claim 1, wherein at the axial outlet of the exit guide vane, the first radially outer platform includes a first radially outer ring that extends radially outward to a first radially outer end, and at the axial inlet of the pre-diffuser, the second radially outer platform includes a second radially outer ring that extends radially outward to a second radially outer end, wherein when the axial outlet of the exit guide vane is disposed axially against the axial inlet of the diffuser:

the first radially outer ring is radially aligned with, and axially opposes, the second radially outer ring so that the first radially outer ring forms a first outer W-seal land and the second radially outer ring forms a second outer W-seal land.

3. The system in accordance with claim 2, wherein the pre-diffuser and EGV assembly exhibit different thermal expansion rates.

4. The system in accordance with claim 2, wherein one of the first plurality of tabs and the second plurality of tabs is arranged in pairs, and wherein another of the first plurality of tabs and the second plurality of tabs is arranged so that each tab thereof fits between one of the pairs.

5. The system in accordance with claim 2, wherein the pre-diffuser is linked to an inner diffuser case, and wherein the inner diffuser case supports the second plurality of tabs.

6. A gas turbine engine, comprising:

a compressor;

an exit guide vane assembly that includes a first radially inner platform, a first radially outer platform, an axial outlet, and a plurality of exit guide vanes circumferentially distributed between the first radially inner platform and the first radially outer platform, wherein at the axial outlet, the first radially inner platform includes a first radially inner ring that extends radially inward to a first radially inner end, and a first plurality of tabs extend in an axial downstream direction from the first radially inner end, the first plurality of tabs being circumferentially spaced about the first radially inner end, a pre-diffuser assembly that includes a second radially inner platform, a second radially outer platform, and an axial inlet, wherein at the axial inlet, the second radially inner platform includes a second radially inner ring that extends radially inward to a second radially inner end, and a second plurality of tabs extend in an axial upstream direction from the second radially inner end, the second plurality of tabs being circumferentially spaced about the second radially inner end, wherein when the axial outlet of the exit guide vane is disposed axially against the axial inlet of the diffuser:

the first radially inner ring is radially aligned with, and axially opposes, the second radially inner ring so that the first radially inner ring forms a first inner W-seal land and the second radially inner ring forms a second inner W-seal land, and the first plurality of tabs are axially aligned with, and circumferentially engage, the second plurality of tabs to prevent rotation of the exit guide vane assembly relative to the pre-diffuser assembly.

7. The engine of claim 6, wherein at the axial outlet of the exit guide vane, the first radially outer platform includes a first radially outer ring that extends radially outward to a first radially outer end, and at the axial inlet of the pre-diffuser, the second radially outer platform includes a second radially outer ring that extends radially outward to a second radially outer end, wherein when the axial outlet of the exit guide vane is disposed axially against the axial inlet of the diffuser:

the first radially outer ring is radially aligned with, and axially opposes, the second radially outer ring so that the first radially outer ring forms a first outer W-seal land and the second radially outer ring forms a second outer W-seal land.

8. The gas turbine engine in accordance with claim 7, wherein the pre-diffuser and EGV assembly exhibit different thermal expansion rates.

9. The gas turbine engine in accordance with claim 7, wherein w-seals span first and second gaps respectively between the EGV assembly and the pre-diffuser.

10. The gas turbine engine in accordance with claim 7, wherein one of the first plurality of tabs and the second plurality of tabs is arranged in pairs, and wherein another of the first plurality of tabs and the second plurality of tabs is arranged so that each tab thereof fits between one of the pairs.

11. The gas turbine engine in accordance with claim 7, wherein the pre-diffuser is linked to an inner diffuser case, and wherein the inner diffuser case supports the second plurality of tabs.

12. A method of configuring a system for a gas turbine engine, comprising:

providing an exit guide vane assembly that includes a first radially inner platform, a first radially outer platform, an axial outlet, and a plurality of exit guide vanes circumferentially distributed between the first radially inner platform and the first radially outer platform, wherein at the axial outlet, the first radially inner platform includes a first radially inner ring that extends radially inward to a first radially inner end, and a first plurality of tabs extend in an axial downstream direction from the first radially inner end, the first plurality of tabs being circumferentially spaced about the first radially inner end providing a pre-diffuser assembly that includes a second radially inner platform, a second radially outer platform, and an axial inlet, wherein at the axial inlet, the second radially inner platform includes a second radially inner ring that extends radially inward to a second radially inner end, and a second plurality of tabs extend in an axial upstream direction from the second radially inner end, the second plurality of tabs being circumferentially space about the second radially inner end, disposing the axial outlet of the exit guide vane axially against the axial inlet of the diffuser so that the first radially inner ring is radially aligned with, and axially opposes, the second radially inner ring so that the first radially inner ring forms a first inner W-seal land and the second radially inner ring forms a second inner W-seal land, and the first plurality of tabs are axially aligned with, and circumferentially engage, the second plurality of tabs to prevent rotation of the exit guide vane assembly relative to the pre-diffuser assembly; and allowing differential axial and radial thermal expansion between the pre-diffuser and the EGV assembly.

13. The method in accordance with claim 12, wherein at the axial outlet of the exit guide vane, the first radially outer platform includes a first radially outer ring that extends radially outward to a first radially outer end, and at the axial inlet of the pre-diffuser, the second radially outer platform includes a second radially outer ring that extends radially outward to a second radially outer end, wherein when the axial outlet of the exit guide vane is disposed axially against the axial inlet of the diffuser:

the first radially outer ring is radially aligned with, and axially opposes, the second radially outer ring so that the first radially outer ring forms a first outer W-seal land and the second radially outer ring forms a second outer W-seal land.

14. The method in accordance with claim 13, comprising interlocking the first plurality of tabs and the second plurality of tabs.

15. The method in accordance with claim 14, wherein one of the first plurality of tabs and the second plurality of tabs is arranged in pairs, and wherein another of the first plurality of tabs and the second plurality of tabs is arranged so that each tab thereof fits between one of the pairs.

* * * * *